United States Patent [19]

Alonso et al.

[11] Patent Number: 4,554,855

[45] Date of Patent: Nov. 26, 1985

[54] PARTIAL TIMBRE SOUND SYNTHESIS METHOD AND INSTRUMENT

[75] Inventors: Sydney A. Alonso, Stafford; Cameron W. Jones, Wilder, both of Vt.

[73] Assignee: New England Digital Corporation, White River Junction, Vt.

[21] Appl. No.: 572,625

[22] Filed: Jan. 24, 1984

Related U.S. Application Data

[63] Continuation of Ser. No. 358,096, Mar. 15, 1982, abandoned, which is a continuation of Ser. No. 163,439, Jun. 7, 1980, abandoned.

[51] Int. Cl.[4] ..... G10H 1/06

[52] U.S. Cl. ..... 84/122; 84/1.01

[58] Field of Search ..... 84/1.01, 1.03, 1.19, 84/1.22, 1.24, 1.23, 1.25

[56] References Cited

U.S. PATENT DOCUMENTS 4,301,704 11/1981 Nagai et al. ..... 84/1.19

4,416,180 11/1983 Ichigaya ..... 84/1.23

*Primary Examiner*—Forester W. Isen

*Attorney, Agent, or Firm*—Robert Shaw

[57] ABSTRACT

Apparatus and method for generating complex sounds having a more natural and agreeable quality wherein fundamental and higher order components may be uniquely and independently controlled to inexact integer relationships.

1 Claim, 10 Drawing Figures

PARTIAL TIMBRE SOUND SYNTHESIS METHOD AND INSTRUMENT

This application is a file wrapper continuation of Ser. No. 358,096, filed Mar. 15, 1982, now abandoned, which is a continuation of Ser. No. 163,439, filed June 27, 1980, now abandoned.

The present invention relates to the field of electronic musical instruments and in particular to electronic musical instruments called upon to produce complex sounds which may emulate natural or traditional musical sounds, in contrast to sounds of pure functions commonly labeled as electronic sound.

Attention is called to the article "Music Synthesis Using Real Time Digital Techniques," Proceedings of the IEEE, vol. 68, No. 4 (1980).

The production of sounds by electronic mechanisms heretofore have both benefited and suffered from the exact capabilities of the electronic arts. The relative ease with which pure functions can be generated and exact relationships maintained has encouraged the construction of electronic musical instruments producing pure sounds at exact relationships. Such sounds are tolerated as electronic sounds, but are less than acceptable as musical sounds by comparison to natural or traditional sounds.

Previous attempts to lend a more acceptable musical timbre to synthesized sounds include adding a predetermined unevenness or modulation to the tone generated. This predetermined unevenness has been applied to each of the different components into which each musical sound may be decomposed, which consist of the amplitude of the fundamental and each harmonic, and the frequency of the musical note. As discussed in "Analysis of Musical Instruments Tones," Physics Today, vol. 22, No. 2, pp. 23–30 (1969), by Jean-Claude Risset and Max V. Mathews, each of the above mentioned parameters vary in traditional musical instruments and may be thusly controlled in musical sound synthesis to create a sound resembling the traditional musical instruments. However, this technique is limited by the exclusion of the variabilities of the other parameters of sound discussed below.

A further advance has been noted in the U.S. Pat. No. 4,108,121 of Chowning, issued Apr. 19, 1977, which achieved a particularly useful method of musical variation of certain sound parameters, those being the frequency of the note and the spectral purity of the fundamental and harmonics in a related manner. The variation of the frequency and spectral parameters in the Chowning patent is achieved through the use of frequency modulation of the fundamental (where the fundamental signal has harmonics at exact integer multiples) by a single modulation signal; the modulation signal has its own waveform frequency and amplitude with a fundamental component and its own harmonic components. The effect achieved is to divide each of the spectral components of the single signal into additional signals having other components related to the modulating signal.

Heretofore, most electronic musical instruments, including instruments incorporating the above techniques in the Chowning patent, produce notes having singular specific components at exact integer multiples of the fundamental frequency. The notes when produced, have essentially uniform characteristics of timbre, timbre being a musical quality of a sound other than pitch or loudness that identifies a sound as emanating from a particular source (e.g., a piano or a human).

The term pitch, though often replaced by the term frequency, has an important distinction from the concept of frequency. This distinction has important relevance to a listener-perceived naturalness to sounds, whether synthesized or produced by traditional musical instruments. Frequency may be defined in terms of a reciprocal time period T, such that any event which occurs at a time t, or A(t), will exactly recur at time t+T, or A(t+T). The definition of pitch may be found in several texts; a typical definition is stated in "The Acoustical Foundations of Music," by J. Backus, W. W. Norton & Co., Inc., (1969) at p. 112: "Pitch is our subjective evaluation of the frequency of the sound; for any given frequency there will by perceived a certain pitch . . . ". Furthermore, it is held that a specific pitch is found by the listener to a sound which has no frequency (i.e., no periodicity) by the above definition, either near the perceived value of the pitch, or at all. Therefore, between the concepts of frequency and pitch, it is pitch which is more central to the production of acceptable musical sounds. Frequency is important as it relates to the formation of the pitch of musical sounds, and as it relates to purer functions, that is, those which are more easily described mathematically.

Similarly, it is the ease of describing notes in terms of a fundamental frequency and harmonic frequencies having exact integer relationships to the fundamental frequency, for instance where the fundamental is f and the harmonics are 2f, 3f, 5f, 7f, etc., which has led to a traditional concept that when a note is referred to as having a fundamental and harmonics, the harmonics are generally presumed to be single frequency components at exact frequency multiples of the fundamental pitch; however, a note may have a plurality of harmonics in an inexact integer relationship (also called "higher order components" herein), of a piano, for example, to a perceived fundamental frequency in the vicinity of the integer multiples of the perceived fundamental frequency.

Heretofore, the synthesis of musical tones has been accomplished by the use of pure and modulated single fundamental signal and singular harmonic signals of exact integer multiples of the fundamental frequency. The present inventors have discovered improvement occurs when multiple fundamental signals and multiple harmonic signals are used (the fundamental signals above the lowest fundamental are also referred to herein as higher order components); furthermore, the higher order components are not exact integer multiples of the lowest fundamental frequency and each is independently adjustable in frequency and amplitude relative to the exact integer multiples. It is therefore an object of the present invention to provide apparatus for synthesizing complex acoustical sounds which provides multiple fundamental and harmonic signals in which independent control is achieved of each fundamental and each harmonic signal frequency relative to the exact integer multiples of the perceived fundamental frequency, or pitch of the sound.

Also, prior synthesizing techniques have assumed or created fundamental signals (i.e., higher order components) and harmonic signals to have the same general spectral envelope for each defined note. Here, an example of a spectral envelope, or the overall amplitude (peak) value of the spectrum with respect to the frequency, is typically exemplified by a (sin x)/x plot commonly found in communication theory. The present inventors have further discovered that for each note the spectral envelopes of the fundamental signal and each harmonic signal (i.e., each higher order component) should be separately adjustable. It is therefore another object to provide independent control of the spectral envelope of the fundamental signal of an acoustical sound and each higher order component thereof.

An additional object is to provide a musical sound comprising the independently controlled fundamental signal and each higher order component thereof.

A further object is to provide unified control of the independently controlled fundamental signal and higher order components which are combined to form musical sounds.

A still further object is to provide an instrument which embodies the above mentioned objects.

These and still further objects are addressed below.

The above objects are provided generally by generating a musical (or other) sound from several separate musical waveforms. Each waveform may be as similar or dissimilar as desired to produce the desired tone timbre. The characteristics of the waveforms which may be varied include the waveform reproduction periodicity, spectral components, and amplitude. In addition, the waveform signal, or the waveform itself may be adjusted in a predetermined manner: the resulting signals are added to form the musical sound having a pitch. The tone is reproduced by an amplifier and speaker to produce an audible signal.

The invention is described hereinafter with reference to the accompanying drawing in which.

Figure 1A:
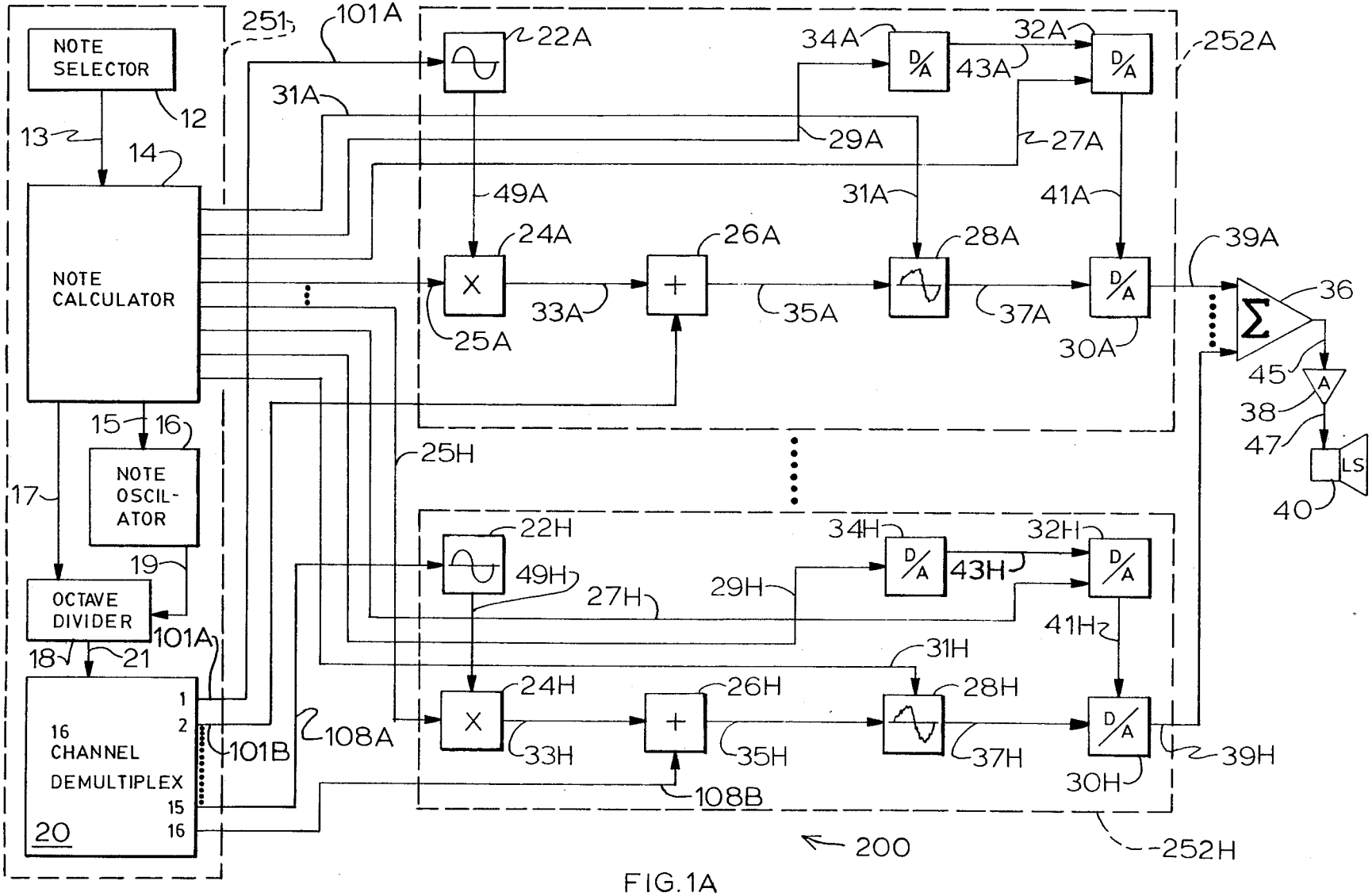
FIG. 1A shows diagrammatically an overall musical instrument according to the present invention.
Figure 5A:
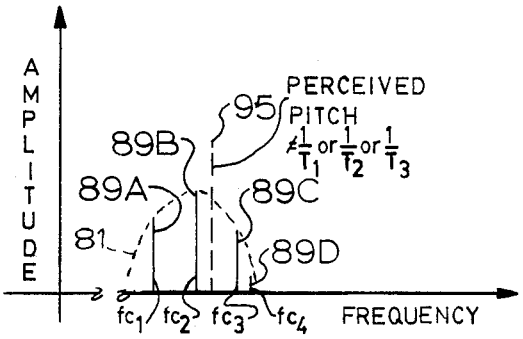
FIG. 5A shows the spectrum of a tone having multiple fundamental signals, with the perceived pitch of the tone at a fundamental frequency not related to any of the fundamental signals.

An instrument employing the present inventive concepts is shown at 200 in FIG. 1A; it includes a note selector 12 by which the instrument player specifies a note and a note calculator 14 which provides the internal signals necessary to generate a plurality of digital waveforms each having a period, amplitude, and spectral components, for instance components 89A, 89B, 89C and 89D in FIG. 5A, to form at least one spectral envelope 81. Each digital waveform generated by the note calculator 14 is stored in a waveshape memory 28A . . . and is sampled to provide periodic digital outputs at 37A . . . by sampling signals from a note oscillator 16. (See U.S. Pat. No. 4,279,185 to Alonso for a detailed discussion of storing and sampling a digital waveform of the type stored in memories 28A . . . . ) The digital output signal of each memory 28A . . . is connected to a D/A converter 30A . . . which converts and further adjusts the waveform thus generated. The functions provided by the D/A converter 30A . . . include amplitude, attack, delay of attack, initial decay control, final decay control, overall volume control, and duration of sustain before decay. The converter outputs are combined or summed with the outputs of the other converters, each of which forms a partial timbre channel; the combined output is amplified and reproduced by a loudspeaker, providing audible sound.

The elements of the instrument 200 of FIG. 1A may be grouped functionally as follows. A note specification system 251 consists of the note selector 12, the note calculator 14, the note oscillator 16, an octave divider 18, and a 16-channel demultiplexer 20. The note specification system 251 receives all player commands, calculates all necessary parameters as a result of the player commands, and generates necessary control signals. The control signals of the note specification system 251 are connected as input to eight identical timbre channels 252A . . . 252H each consisting of a sine-wave read-only-memory (ROM) 22A . . . , a multiplier 24A . . . , an adder 26A . . . , a waveform memory 28A . . . , and D/A converters 30A . . . , 32A . . . , and 34A . . . . Each D/A converter 30A . . . 30H provides an analog output called a partial frequency from each partial timbre channel 252A . . . . Typically, each musical sound has several partial frequencies which together relate, for example, to a single key depressed on a keyboard contained in the note selector 12. The partial frequencies are summed by a summing amplifier 36 to provide a tone output that is amplified by an amplifier 38, and converted to audible sound by a speaker 40.

The note specification system 251 of the instrument 200 of FIG. 1A, and in particular the note selector 12, the note calculator 14, the note oscillator 16 and the octave divider 18 are generally described in an application for Letters Patent entitled "High Resolution Musical Note Oscillator and Instrument that Includes the Note Oscillator," Ser. No. 144,525, filed on or about Apr. 2, 1980 (now U.S. Pat. No. 4,345,500) by the present inventors, which application is hereby incorporated by reference.

Figure 1B:
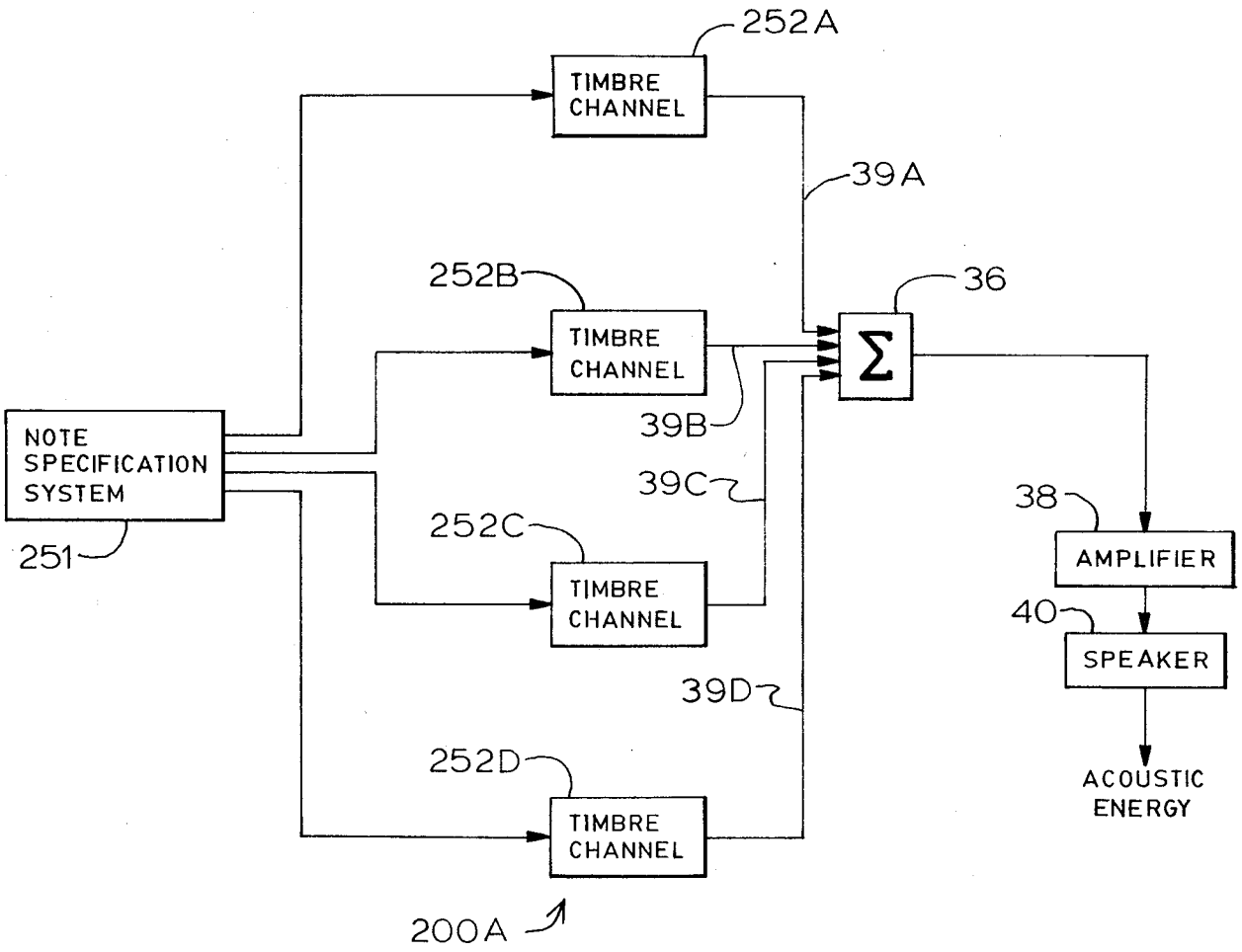
FIG. 1B shows a particular configuration of the overall musical instrument of FIG. 1A, wherein a single note comprises four timbre channels.

The note selector 12 of FIG. 1 ordinarily includes a keyboard, a control knob, and an array of pushbutton switches; additional controls may be included as desired. The note selector 12 also includes various lights which indicate which function has been selected by operation of the pushbutton switches, and a numeric display which indicates numeric values, where appropriate, of operations initiated by a player of the instrument 200. The above controls and display signals are combined along a multiconductor lead 13 to the note calculator 14. The lead 13 carries note signals and control signals between the note selector 12 and the note calculator 14 as discussed in the above-noted earlier patent application Ser. No. 144,525.

The note calculator 14, also described in the patent application Ser. No. 144,525 of the present inventors, provides the note oscillator 16 and the octave divider 18 with the information needed to produce oscillator outputs of different frequencies at the 16-channel demultiplexer 20, which may be of the type described in the earlier patent application or other possible embodiments. In addition, the note calculator 14 provides a digital wave signal to the waveform memory 28A . . . described below. The digital wave signal has frequency components that include a fundamental and harmonic components which are integer frequencies at exact multiples of the fundamental frequency specified by the player. The note calculator 14 further provides a delay time after the note is initiated (by, for example, the depression of a key on a keyboard or other player control), the attack or risetime in amplitude of the partial timbre, the peak amplitude of the timbre, the sustain time of the peak amplitude, and the decay time in amplitude after the partial timbre attains the peak amplitude. Similarly, the frequency modulation characteristics, such as delay time, attack time, peak level, sustain time, decay time of the frequency modulation signal and ratio of the modulation frequency to pitch are stored and provided to the alternate channels of the note oscillator 16: for instance the first, third, fifth, etc., channels of the note oscillator 16 which may be combined with the second, fourth, sixth, etc., channels of the note oscillator 16 at a point after the 16-channel demultiplexer 20 (within the timbre channels 252A . . . ) to provide the frequency modulation effect explained below.

Figure 6:
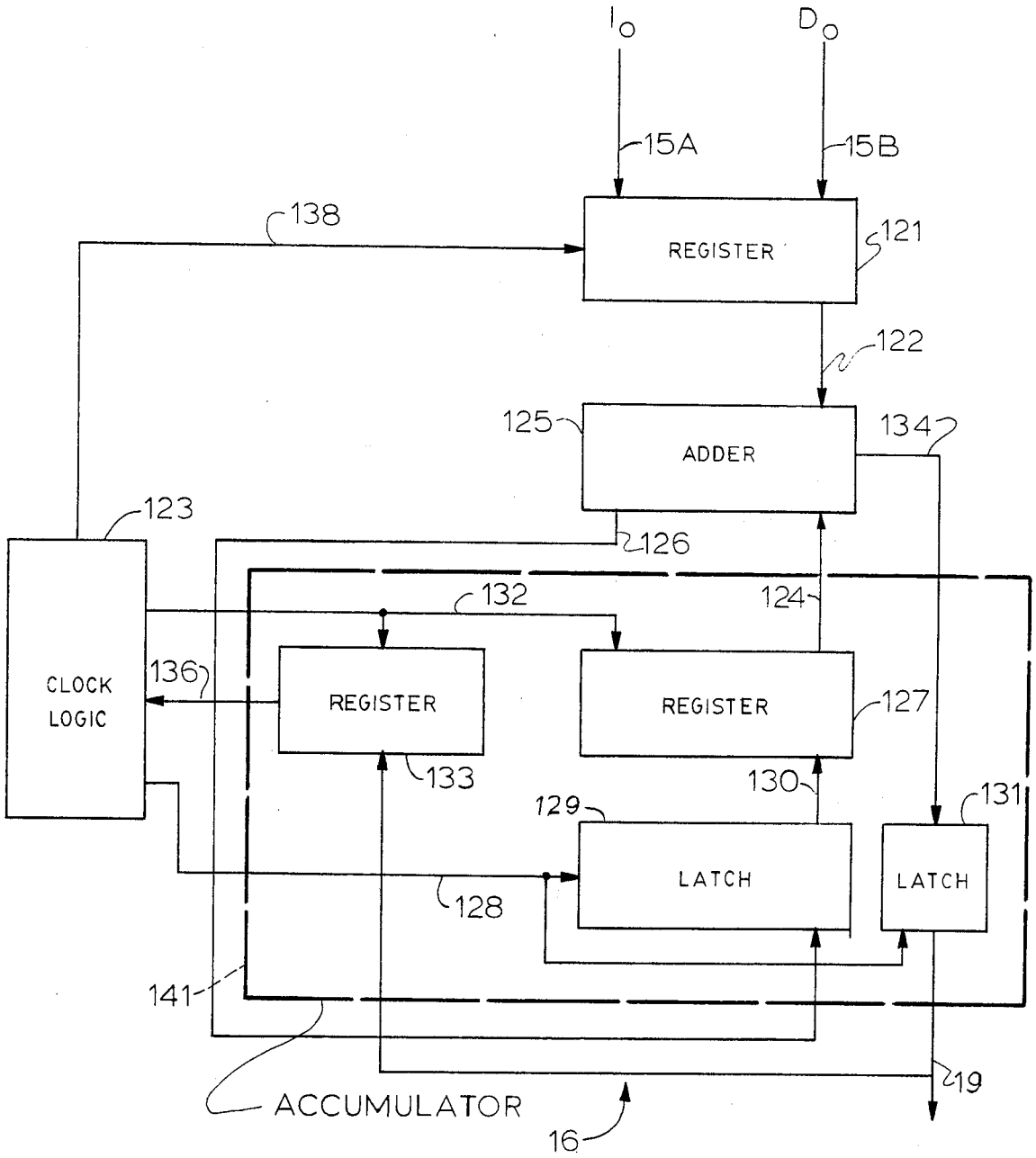
FIG. 6 shows diagrammatically a note oscillator of the instrument of FIG. 1A.

The note oscillator 16 is shown in more detail in FIG. 6. The note calculator 14 sends Io and Do signals over leads labeled 15A and 15B, shown as 15 in FIG. 1A. The Io, also called the fractional increment number, and Do signals are received by a register 121 for temporary storage. A clock logic 123 generates pulses at predetermined periodic repetition rates which are sent to other elements of the note oscillator 16. An adder 125 receives second adder input signals from a register 121 and first adder input signals from the register 127 over leads 122 and 124, respectively. The adder 125 has a sum output appearing on lead 126 received by latch 129 and stored according to control signals provided the clock logic 123 over lead 128. The signal stored in the latch 129 is received by register 127 over lead 130 and stored according to a clock logic 123 control signal on lead 132. The register output provides a first adder input signal to the adder 125 over lead 124 as discussed above. The registers 127 and 133 and latches 129 and 131 operate in concert to form a data accumulator 141. The adder 125 has a modulus and provides a carry-out signal on lead 134 to be received by the latch 131; the carry-out signal on the lead 134 to be received by the latch 131; the carry-out occurs when the capacity of the adder 125 is exceeded. The carry-out signal on lead 134 is stored in the latch 131 on the occurrence a control signal 128 from the clock logic 128 and provides an oscillator output signal at lead 19, sent on to the octave divider 18 of FIG. 1A and back into the oscillator 16 to the register 133, to store the overflow signal on the occurrence of a control signal at 132 from the clock logic 123. The register 133 also sends a signal over lead 136 to the clock logic 123 which causes a signal to be sent over lead 138 to the register 121 which causes the Do signal to be provided to the second adder input over the lead 122. The Io signal or fractional input number has a greater numeric resolution by comprising digital signal elements (called bits) less significant than the Do number. The clock logic 123 causes the Io signal to be periodically added until a carry-out (overflow) occurs as shown by a signal on the lead 134, and later on the lead 140 and then on the lead 136, and finally the lead 138. The signal on the lead 138 causes the Do signal to be added on the next period only; thereafter, the Io is again added by adder 125 until another overflow occurs. The period of the output pulses on the lead 19 is proportional to the two signals Io and Do received over leads 15A and 15B respectively. By time multiplexing the Io and Do signals and providing multiple storage locations in the registers 121, 127, 133 and the latches 129 and 131 which have the adder's locations aligned in time with the various Io and Do numbers, multiple time-multiplexer clock output signals appear at the lead 19, each of which is divided appropriately by the octave divider 18 and demultiplexed by the demultiplexer 20 to provide typically sixteen independent channels of oscillator signals connected in the instrument 200 as discussed elsewhere herein.

Each digital wave signal received and stored in any particular wave memory 28A . . . is created in the note calculator 14 of FIG. 1 (see for example, the note calculator and the flow chart and program therefor disclosed in United States Letters Patent 4,108,035 of the inventor Alonso herein) and connected to the respective wave memory by a lead 31A . . . . The fundamental and harmonic components of the waveform and the relative amplitudes of each are selected by the user of the instrument 200 who, for instance, may depress a pushbutton to select a specific wave component. Thereafter, the player will operate another note selector 12 device, such as a continuously variable voltage source for example, which will provide a value relative to the wave component specified by the particular pushbutton depressed. The note calculator 14 will then create a waveform which has the specified wave component. Subsequently, the user will select other wave components and specify the relative value of each, where each subsequent wave component is added to the first of the components, to form a composite wave which subsequently is sent to a waveform memory 28A . . . of the appropriate timbre channel 252A . . . .

Figure 3A:
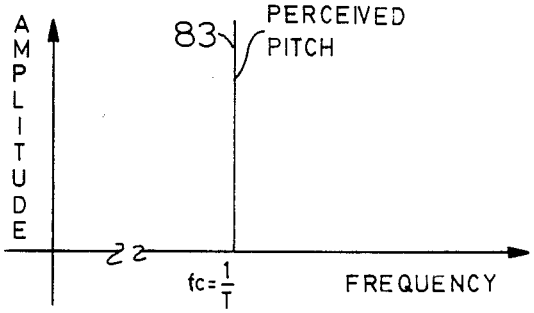
FIG. 3A shows the spectrum of a simple sine wave produced by the instrument in FIG. 1.
Figure 3B:
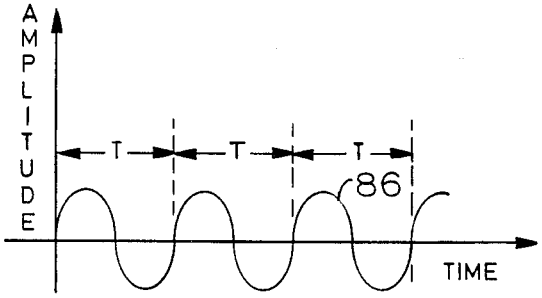
FIG. 3B shows the time domain plot of the sine wave of FIG. 3A.

FIG. 3A shows the spectral signal labeled 83 of the sine function in FIG. 3B, that is, the logarithmic amplitude with respect to the frequency in FIG. 3B. The evenness of the sine function shown at 86 in the time domain plot of FIG. 3B (linear amplitude versus time) allows the spectral signal 83 to exist only at a single frequency. This signal frequency is inversely related to a constant time period T, of the time-domain sine plot 86. The sine function is provided by the note calculator 14 in FIG. 1 along lead 31A . . . if the instrument 200 player commands a spectral component signal 83 only at a fundamental frequency.

Figure 4A:
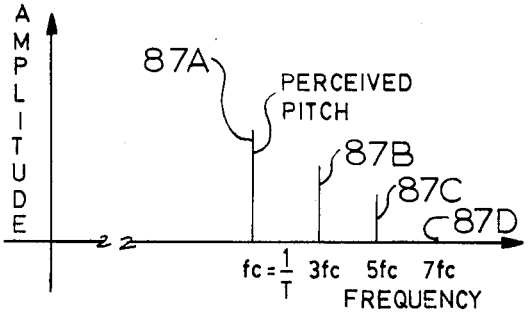
FIG. 4A shows the spectrum of a square wave.
Figure 4B:
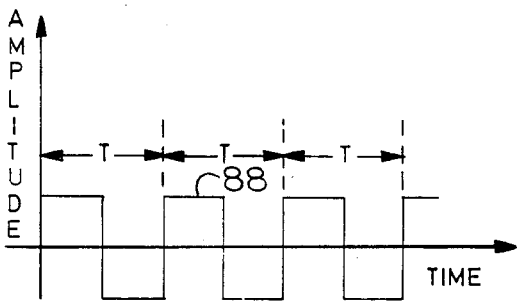
FIG. 4B shows the time domain plot of the square wave of FIG. 4A.

If the player of the instrument 200 desires a more interesting sound, he may decide to create a note having spectral signals in addition to the fundamental frequency: e.g., the note reproduced by the square-wave shown in FIG. 4B and comprising spectral components 87A, 87B, 87C, and 87D in FIG. 4A. The component 87A is the fundamental and 87B, 87C, and 87D are odd integer multiples thereof. Here, again, as in the sine wave discussed above, the fundamental frequency 87A is inversely related to a time period that is constant throughout time.

Figure 2:
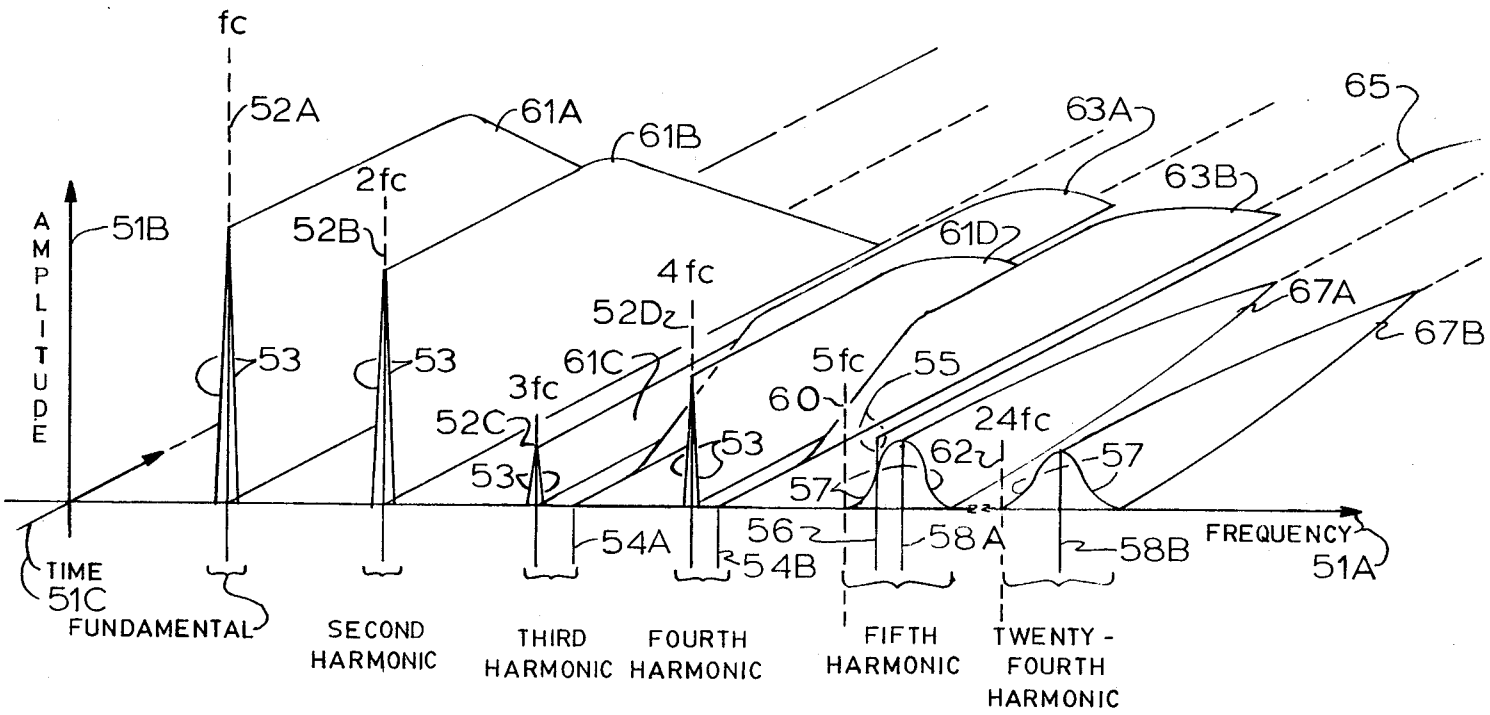
FIG. 2 shows the spectrum of a tone which may be produced by the instrument of FIG. 1A in the time and amplitude dimensions.
Figure 5B:
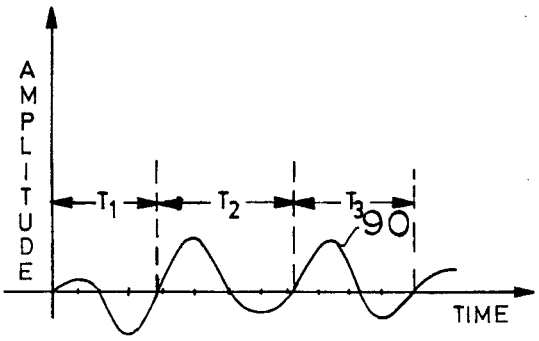
FIG. 5B shows a time domain plot of the signal of FIG. 5A.

A more complex sound is shown in FIG. 5A which may have no frequency by the standard definition explained earlier, but rather a perceived pitch 95 which, in view of the time domain plot of FIG. 5B of the function designated 90, has no relation to the time periods marked $T_1$, $T_2$, $T_3$, all of which differ one from another. The function 90 in FIG. 5B is composed of multiple spectral components 89A, 89B, 89C, and 89D in FIG. 5A in the general frequency vicinity of the perceived pitch 95. Any frequency which may exist, will be related to at least several time periods $T_1$, $T_2$, $T_3$, according to the definition of frequency. Additional wave functions at related (e.g., 87A . . . ) or unrelated (e.g., 89A . . . ) frequencies to create unique sounds of the type represented by the three-dimensional plot in FIG. 2 are discussed below.

The note amplitude dynamic information, including initial attack time or the time period for the initial increase of the tone amplitude, delay of the onset of the initial increase, the peak amplitude achieved, duration or sustain time of the peak amplitude, an initial decay time, and a final decay time of each of the eight partial timbre waveforms are selected by suitable means in the note selector 12 from a signal as adjusted by an appropriate control (e.g., a continuously variable voltage source in the note selector 12 of FIG. 1). After being selected, the peak amplitude is stored in the note calculator 14 and provided to an appropriate first D/A converter 34A . . . along lead 29A . . . The remaining amplitude information which includes attack, delay, sustain, initial decay and final decay times are received and stored by the note calculator 14 and combined to form a proper control signal at 27A . . . to control a second D/A converter 32A . . . according to the specified times. The control signal at 27A . . . will cause a relative change in the effect of the first D/A 34A . . . output signal at 43A . . . in the following sequence. The output of the second D/A converter 32A . . . will remain zero for the duration of the specified delay time; for the time period specified by the attack, the amplitude of the output at 41A . . . builds up from zero to the value specified by a peak amplitude on the appropriate lead 29A . . . The amplitude at output 41A . . . from the particular D/A converter 32A. . . will be maintained for the duration in milliseconds as specified by the sustain time, after which it will begin an initial decay according to an initial decay time specified as milliseconds. Thereafter, the amplitude of the signal at 41A . . . begins a final decay after a specified time to zero value. See also U.S. Pat. No. 4,178,822 of one of the present inventors which further describes amplitude envelope control, which Letters Patent are hereby incorporated herein by reference.

The note calculator 14 also controls several frequency or period related functions. A portamento time, or rate at which one pitch smoothly changes to the next pitch, may be specified and produced by the note calculator 14. This is implemented by continuously changing the numbers sent to the note oscillators 16 is small increments, rather than a singular change in numbers, as the selected pitch is changed. Vibrato, an effect which is similar to frequency modulation, is implemented in a manner similar to portamento, that is, by the numbers sent to the note oscillator 16 by the note calculator 14. Vibrato is specified by a waveform, a rate at which the waveform occurs, a depth of amplitude by which that depth increases from zero to the specified value of depth.

The musical notes may also be frequency modulated under the control of the note calculator 14 and by the effect of combining the sixteen oscillator signals at outputs 101A, 101B . . . , 108A, 108B of the demultiplexer 20 to form eight pairs of signals. The first of the paired oscillator signals is typically adjusted to provide a signal having a fixed (proportional) relationship to the second of the paired oscillator signals (called the F.M. ratio); for instance 101A (of the pair 101A and 101B) is used to sample a stored sine waveform in the sine ROM 22A . . . to yield an output signal at 49A . . . which is the amplitude value of the sine function at each sample point. The sine ROM 22A . . . output at 49A . . . is modified by a multiplier 24A . . . in response to an amplitude signal at 25A . . . which is related to the frequency modulation peak value as specified by the player of the instrument 200. The output from the particular multiplier 24A . . . modulates the second of the paired oscillator channels signals on the lead 101B . . . 108B by an addition operation in the adder 26A . . . whose output at 35A. . . samples the waveform memory 28A . . . The combined waveform memory output at 37A . . . ultimately becomes the desired musical sound, discussed below. The amplitude signal at 25A . . . includes the frequency modulation information controlling the attack of the frequency modulation, the delay before the onset of the frequency modulation, the peak value and duration in milliseconds of the frequency modulation over which the modulation is to be sustained, and the decay of the frequency modulation of the timber channels, each specifiable by the player of the instrument 200.

The instrument 200 may generate a pluraity of independent notes to provide polyphony, that is, a plurality of notes produced simultaneously, each with arbitrary complexity. However, as the complexity of each tone increases, the number of notes available from the instrument 200 decreases. The reason is that the instrument 200 has a finite number of timbre channels 252A, 252B . . . which are available to be assigned to form a single tone. Each timbre channel 252A . . . may either singly or in combination with other channels become an independent tone channel. The number of tone channels may be extended by adding more hardware to provide as many notes as desired.

The partial timbre channel 252A of the instrument 200 in FIG. 1A, is now discussed in greater detail. The partial timbre channel 252A includes the waveform memory 28A which provides a predetermined waveform according to the note output of the note specification means 251. The waveform provided by the waveform memory 28A is typically a predetermined waveshape loaded into the wave memory 28A by the note calculator 14 along lead 31A. The waveshape may be predetermined, calculated, or created according to the means and processes explained above and below. The waveform produced at 37A comprises a digital signal which, when converted to analog form by the third D/A converter 30A, provides an analog signal at 39A which has the desired spectral components. The spectral components are derived from the waveshape in the memory 28A; the most regular is sine function 86 in FIG. 3B, which has a single, pure component 83 in FIG. 3A at the fundamental frequency. The fundamental period is the period required to completely reproduce the stored waveform in the memory 28A before the stored waveform is repeated. The spectral components are also controlled by variations to the fundamental rate applied at the lead 25A as provided by the note calculator 14 explained above in relation to portamento and vibrato. The frequency modulation fundamental rate (typically one of the oscillator signal channels, such as 101B) is modified by another rate (or the oscillator signal channels, such as 101A) by action of the adder 26A, as explained above. A still further manner of adjusting the spectral components, or in this case the entire waveform, is by adjusting the amplitude of the analog signal at 39A by the use of a second input lead 41A to the third D/A converter 30A. The signal sent to the second input 41A is provided by the second D/A converter 32A and is derived as explained above.

An example of the spectral components of a complex musical tone which may be produced by the instrument 200 of FIG. 1A is shown in FIG. 2, but is not to be held as the only example possible, or in any other way limiting. In the explanation now made for simplicity, the instrument 200 is assumed to have the four timbre channels 252A, 252B, 252C, and 252D shown as instrument 200A in FIG. 1B that produce a single musical tone. The plot of FIG. 2 shows frequency 51A versus amplitude 51B and both frequency 51A and amplitude 51B versus time 51C. The spectral components are shown with the fundamental 61A located at the lowest (leftmost) position 52A on the frequency axis 51A, followed by the second multiple of the fundamental (often called the second harmonic) 61B, the third harmonic 61C and the fourth harmonic 61D, where the components 61A, 61B, 61C, and 61D (having center frequencies 52A, 52B, 52C, and 52D, respectively) are all a result of a single partial timbre channel, here 252A. The frequency of the second timbre channel 252B is set slightly higher than an exact multiple of the fundamental frequency 52A; the exact multiples of the fundamental frequency at 52A for the third and fourth harmonic are 52C and 52D, respectively. The components 63A and 63B (collectively referred to as 63), coming from the same timbre channel 252B, have the same amplitude envelope, that is, the amplitude versus frequency relationship of the frequency components are all proportionally identical. Hence, although the maximum (peak) value of the components 63A and 63B differ, the amplitude changes of the two components 63A and 63B all occur in the same manner at the same time. This is because the two components 63A and 63B originate from the same waveform generated by the same waveform memory (here it would be a memory in the timbre channel 252B, which similar to the memory 28A in the timbre channel 252A in FIG. 1A) and controlled by D/A converters (like 30A and 34A) which control the amplitude characteristics, as explained above. The broken line marked 60 represents the frequency of the fifth harmonic of the fundamental 52A, except that according to the present teaching no such fifth harmonic is generated at that exact frequency. Instead the higher order component marked 65 is generated; it has a separate amplitude envelope and a harmonic frequency at 56 and is slightly removed from the fifth multiple frequency at 60, and has a spectral bandwidth marked 55. The component 65 is generated by the third partial timbre channel 252C. The other harmonic component of the fifth harmonic group is marked 67A; higher harmonics; e.g., the twenty-fourth harmonic designated 67B (collectively referred to as 67) are produced by the fourth partial timbre channel 252D. Here the relationships of the component frequencies 58A and 58B to the exact multiples frequences 60 and 62, respectively, are proportionally the same, as are also the amplitude characteristics.

Each of the harmonic components of the tone of FIG. 2 has another characteristic, that being the spectral purity or bandwidth. The fundamental component 61A, the second harmonic 61B, the third harmonic 61C, and the fourth harmonic 61D (which are collectively referred to as 61), being created by the same partial timbre channel 252A, typically have the same spectral bandwidth 53. The spectral bandwidth may be rigorously specified at a frequency interval above and below the center frequency of the component where the amplitude drops to a specified value of the center, typically 3 dB. The composite spectral bandwidths of the several components 61, 63, 65, and 67 specified by the instrument player 200 may have several different typical forms: e.g., an impulse function or a value at one frequency and zero at all other frequencies, a group of impulse functions near the harmonic frequency, or a bell-shape wherein the frequencies have a probability of occurring. In the plot of FIG. 2, the purest or narrowest spectral component is shown by the fifth harmonic component 65 whose spectral bandwidth 55 is likely to be provided by an unmodulated sine wave. The third and fourth harmonic components 63A and 63B may also be as narrow as the component 65, but the limitation of the drawing of FIG. 2 cannot reveal the spectral bandwidth of the harmonic components. The harmonic components 61 produced by the first partial timbre channel 252A have a somewhat broader bandwidth 53. Similarly, the fourth partial timbre channel 252D has a still broader spectral bandwidth 57, as shown at the fifth and twenty-third harmonic components 67A and 67B. The bandwidth of the various spectral components, typically, are broadened by modulation of the partial timbre channels. Here, the instrument 200 may use the frequency modulation explained above. The frequency modulating signal may be a predetermined function, such as a sine wave as contained in the sine ROM 22A . . . in FIG. 1, or any other periodic function, or an aperiodic function, as desired. Not shown in FIG. 2 are the effects of vibrato, portomento, and other functions of instrument 200 which are possible, but would have rendered in FIG. 2 difficult to interpret. It is important to note that generation of other notes comprising different harmonic components, both in individual quantity of components and placement (as within each harmonic component group and as to where the harmonic components are on the frequency axis), is possible by the present invention with no foreseeable restriction within the audible range.

A typical musical sound timbre created as that is a string sound, wherein the various parameters discussed above are adjusted according to the following table:

TABLE I

| String Sound: | Partial Timbre Channel 1 | Partial Timbre Channel 2 | Partial Timbre Channel 3 | Partial Timbre Channel 4 |
|---|---|---|---|---|
| Delay | 0.0 | 0.0 | 0.0 | 0.0 ms |
| Attack | 11 | 15 | 11 | 15 ms |
| Initial Decay | 88 | 88 | 99 | 88 ms |
| Final Decay | 190 | 190 | 190 | 60 ms |
| Peak Amplitude | 0 | 0 | 0 | 0 dB |
| Sustain | 100 | 100 | 100 | 100 dB |
| F.M. | | | | |
| Delay | 0 | 0 | 0 | 0 ms |
| Attack | 8 | 11 | 0 | 8 ms |
| Initial Decay | 64 | 47 | 64 | 47 ms |
| Final Decay | 3883 | 3883 | 3883 | 9713 ms |
| Peak | 100 | 322 | 349 | 322 Arb |
| Sustain | 26 | 17 | 14 | 15 Arb |
| Fundamental | 100 | 100 | 100 | 0 Arb |
| Harmonics | | | | |
| 2 | 51 | 50.9 | 50.3 | 0 Arb |
| 3 | 25.1 | 24.8 | 100 | 0 Arb |
| 4 | 23.7 | 39.6 | 39.6 | 23.7 Arb |
| 5 | 13.3 | 13.3 | 13.3 | 13.3 Arb |
| 6 | 6.4 | 10.4 | 10.4 | 6.4 Arb |
| 7 | 3.0 | 3.0 | 3.0 | 3.0 Arb |
| 8 | 1.9 | 1.9 | 1.9 | 1.9 Arb |
| 9 | 0.8 | 0.8 | 0.8 | 0.8 Arb |

TABLE I-continued

| String Sound: | Partial Timbre Channel 1 | Partial Timbre Channel 2 | Partial Timbre Channel 3 | Partial Timbre Channel 4 |
|---|---|---|---|---|
| 10 | 0.5 | 0.5 | 0.5 | 0.5 Arb |
| 11 | 0.2 | 0.2 | 0.2 | 0.2 Arb |
| 12 | 0.3 | 0.3 | 0.3 | 0.3 Arb |
| 13-24 | 0.0 | 0.0 | 0.0 | 0.0 Arb |
| Fundamental Frequency | 440.0 | 440.2 | 439.8 | 440.0 Hz |
| Vibrato: | | | | |
| Wave | Sine | Sine | Sawtooth | Sine |
| Rate | 6.0 | 5.74 | 6.16 | 4.16 Hz |
| Depth | 0.07 | 0.13 | 0.09 | 0.11 Arb |
| Attach | 530 | 199 | 315 | 233 Arb |
| Portamento Rate | 0.346 | 0.400 | 0.400 | 0.400 ms |
| F.M. | | | | |
| Ratio | 4.0 | 4.0 | 4.0 | 4.0 |
| Decay | 0.0 | 0.0 | 0.0 | 0.0 ms |

In Table I the terms ms, dB, Arb and Hz respectively mean milliseconds, decibels, arbitrary units and hertz.

It may be useful at this juncture to return again to FIG. 1 with a few general remarks. The sound synthesizer 200 is capable of generating complex musical (or other) sounds that are like those which a listener has become accustomed to expect from an all analog instrument, e.g., a pipe organ. Such customary sounds, because the instrument producing them has particular acoustical characteristics, do not have mathematical purity but, rather, contain higher order components, for example, which are not exact integer multiples of any fundamental frequency. Thus, the instrument 200 generates many sound frequencies independently of other frequencies and independently controls the characteristics of each to provide a relationship therebetween that can be regulated. The single musical tone depicted in FIG. 2 is a composite formed of a number of independently controlled waveforms stored in the waveform memories 28A . . . , the composite tone having harmonic components 61A-61D, 63A-63B, 65 and 67A-67B; the component 61A-61D ordinarily would have a fifth harmonic at 60, but there is no signal at the frequency 60 in the example given. Rather, that signal is replaced by higher order components 65 and 67A which are both spaced in the frequency spectrum from the exact integral fifth harmonic at 60 of the fundamental frequency at 52A, and the envelopes of the higher order components 65 and 67A are controlled independently from the envelope 61A (whose central frequency is 52A) although the spectral components 61B, 61C and 61C are not controlled independently of the waveshape 61A.

The waveforms that are combined to form the single musical tone depicted in FIG. 2 are generated in digital form by the note specification system 251 and more precisely by the note calculator 14. The digital waveforms, as above indicated, are stored in memories 28A . . . and sampled by signals on respective conductors 101B . . . , the sampling signal being generated by the oscillator 16 to provide digital waveform outputs at 37A . . . which may be periodic or aperiodic. The digital outputs of 37A . . . are converted to analog signals at the respective converters 30A . . . , but adjustments of the digital waveforms in terms of waveform amplitude, spectral components, and so forth, are effected independently in each of the converters 30A . . . by signals 41A . . . . The analog outputs at 39A . . . , then, are combined to produce the complex sounds sought, and those complex sounds, in accordance with the present disclosure, can be regulated in ways that very closely emulate the instrument being imitated—but other complex sounds, not copied, may be generated.

Modifications to the above described preferred embodiment of the present invention as made by those skilled in the art are included within the scope of this invention.

What is claimed is:

1. Apparatus for synthesis of acoustical notes in an electronic instrument, comprising:

means for generating and storing in digital form a plurality of separate electrical signals each having components that can be selected by a user of the instrument from a plurality of fundamentals, harmonics. and non-harmonics independently of the other signals and each having parameters that can be adjusted by the user independently of the parameters of the other signals such that said signals, when combined in analog form, have the pitch, loudness, and timbre characteristics of a designated note;

means controlled by the user for designating from a plurality of acoustical notes an acoustical note for synthesis;

means responsive to the selection of said note for reading out the stored signals; means for combining the read out signals; and means for reproducing the combined signals acoustically to synthesize the selected note; said means for generating comprising a digital oscillator having clock means for generating pulses at a predetermined repetition rate, adder means having a first adder input and a second adder input respectively to receive a first binary input signal formed of binary bits having whole number significance and a second binary input signal formed of binary bits of fractional increment number significance, said adder means being operable to add periodically the first binary input signal and the second binary input signal to produce a sum output and to produce a carry output whenever the capacity of the adder means is exceeded, selected binary bits of the fractional increment number being aligned within the adder means to have a lower order of significance than the bits forming the first binary input signal; accumulator means having an accumulator input and an accumulator output and connected to receive the clock pulses from the clock means and to receive the sum output at the accumulator input and operable to store the sum output and to provide the stored sum output at the accumulator output, the accumulator output being connected to provide the first binary signal input to the first adder input, so that an oscillator output is provided in the form of carry pulses having a rate proportional to the fractional increment number received by the second adder input.

* * * * *